United States Patent [19]

Flick et al.

[11] Patent Number: 4,713,635

[45] Date of Patent: Dec. 15, 1987

[54] MULTI-PHASE CIRCUIT BREAKER WITH INTERPHASE BARRIER RETENTION

[75] Inventors: Robert H. Flick, Brighton Township, Beaver County; Lawrence D. Dennis, North Fayette Township, Allegheny County; Roger E. Walker, Franklin Township, Beaver County, all of Pa.

[73] Assignee: Westinghouse Electric Corp., Pittsburgh, Pa.

[21] Appl. No.: 880,764

[22] Filed: Jul. 1, 1986

[51] Int. Cl.[4] ..... H01H 75/00; H01H 77/00; H01H 83/00

[52] U.S. Cl. ..... 335/8; 335/9; 335/202; 200/303

[58] Field of Search ..... 335/8, 9, 10, 202; 337/45–50; 174/92; 200/303

[56] References Cited

U.S. PATENT DOCUMENTS

| | | | |
|---|---|---|---|
| 3,102,933 | 9/1963 | Berthier | 337/48 |
| 3,797,007 | 3/1974 | Salvati et al. | 335/176 |
| 4,128,822 | 12/1978 | Peterson | 335/9 |

*Primary Examiner*—E. A. Goldberg
*Assistant Examiner*—Lincoln Donovan
*Attorney, Agent, or Firm*—L. P. Johns

[57] ABSTRACT

A multi-phase circuit breaker characterized by a plurality of phase compartments separated by spaced barriers, a circuit breaker structure within compartment and having separable contacts, manually operable handle within one compartment and including a crossbar extending laterally through the compartments and barriers and each barrier having a removable portion that is retained in place by an overlying portion of a handle.

3 Claims, 7 Drawing Figures

MULTI-PHASE CIRCUIT BREAKER WITH INTERPHASE BARRIER RETENTION

CROSS-REFERENCE TO RELATED APPLICATIONS

This invention relates to molded case circuit breakers, such as those disclosed in Ser. No. 858,137, filed Apr. 30, 1986, (W.E. Case 52,893) and Ser. No. 876,557, filed June 20, 1986.

BACKGROUND OF THE INVENTION

1. Field of the Invention

This invention relates to a multi-phase circuit breaker and, more particularly, it pertains to an interphase barrier structure in conjunction with a crossbar and operating handle.

2. Description of the Prior Art

Certain types of circuit breakers utilize molded glass polyester interphase barriers to provide insulation and secondary pivoting support for the mechanism crossbar. The frame incorporates an interchangeable trip unit which requires that the breaker cover be removed to install or change the trip unit. The interphase barrier is retained in position by the cover in normal installation and operation of the breaker. However, there is the possibility of the barrier being dislodged and actually falling out of the breaker when the trip unit is installed or changed, if there were not another means to retain it with the cover and trip unit removed.

SUMMARY OF THE INVENTION

It has been found in accordance with this invention that a multi-phase circuit breaker may be provided comprising a housing having a detachable cover and having a plurality of barriers separating the housing into isolated phase compartments, a circuit breaker structure within each compartment and having a pair of contacts operable to open and close an electric circuit, manually operable means including a handle for opening and closing the contacts simultaneously in the compartments and including a crossbar extending transversely of the compartments and through the barriers, each barrier having a first barrier portion removably mounted in place for supporting the crossbar between the barrier and the first barrier portion, each barrier having surfaces forming a crossbar-receiving opening and the first barrier portion including one of said surfaces, the handle including lateral portions extending over the barriers to obstruct removal of the first barrier portions when the cover is removed from the housing, each barrier in each first barrier portion comprising complementary surfaces forming the crossbar receiving opening, the assembly of each barrier and first barrier portion comprising interlocking grooves and ribs, the cover including a second barrier portion aligned with and in abutment with each barrier when the cover is mounted on the housing, and the first barrier portions being removable when the handle is removed.

The advantage of the device of this invention is that it retains the interphase barriers in place when the breaker cover and trip unit are removed in that a molded handle extends beyond the planes of adjacent barriers as they are assembled, thereby preventing the barriers from falling out of position or out of the breaker, no matter in which position the breaker is disposed.

DESCRIPTION OF THE PREFERRED EMBODIMENTS

Figure 1:
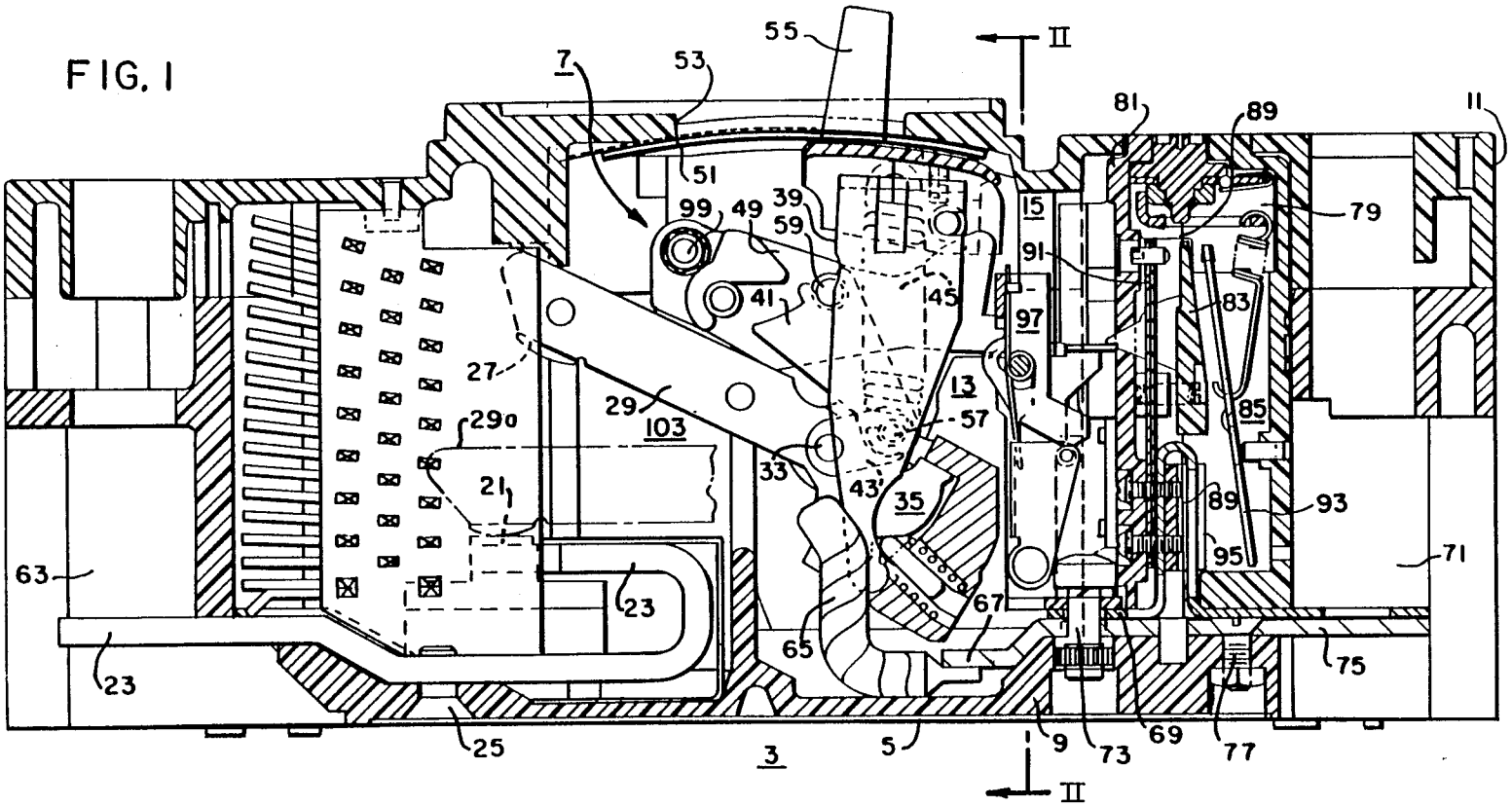
FIG. 1 is a vertical sectional view of a multi-pole circuit breaker.

In FIG. 1, a circuit breaker is generally indicated at 3 and it comprises an insulating housing 5 and a circuit breaker mechanism 7 supported within the housing. The housing 5 comprises an insulating base 9 and an insulating cover 11.

The circuit breaker mechanism 7 comprises an operating mechanism 13, and a latch and trip device 15. Except for the latch and trip device, the circuit breaker 3 is of the type that is generally described in U.S. Pat. No. 3,797,007 and is incorporated by reference herein. The circuit breaker 3 is a three-pole circuit breaker comprising three compartments disposed in side-by-side relationship. The center pole compartment (FIG. 1) is separated from the two outer pole compartments by insulating barrier walls formed with the housing base 9 and cover 11. The operating mechanism 13 is disposed in the center pole compartment and is a single operating mechanism for operating the contacts of all three pole units.

Each pole unit comprises a stationary contact 21 that is fixedly secured to a rigid main conductor 23 that in turn is secured to the base 9 by bolts 25. In each pole unit, a movable contact 27 is secured, such as by welding or brazing, to a contact arm 29 that is mounted on a pivot pin 33. The arm 29 for all three of the pole units is supported at one end thereof and rigidly connected on a common insulating tie bar 35 by which the arms of all three pole units move in unison. Each of the contact arms 29 is biased about the associated pivot pin 33.

The operating mechanism 13 actuates the switch arms 29 between open and closed positions. The mechanism comprises a pivoted formed operating lever 39, a toggle comprising two toggle links 41 and 43, overcenter spring 45, and a pivoted releasable cradle or arm 49 controlled by the trip device 15. An insulating shield 51 for substantially closing an opening 53 in the cover 11, is mounted on the outer end of the operating lever 39 and has an integral handle portion 55 extending out through the opening to enable manual operation of the breaker. The toggle links 41 and 43 are pivotally connected together by a knee pivot pin 57. The toggle link 41 is pivotally connected to the releasable arm 49 by a pin 59, and the toggle link 43 is pivotally connected to the switch arm 31 of the center pole unit by the pin 33.

The overcenter spring 45 is connected under tension between the knee pivot pin 57 and the outer end of the operating lever 39. The circuit breaker is manually operated to the open position by movement of the handle portion 55 in a clockwise direction, which movement actuates the overcenter spring 45 to collapse the toggle links 41 and 43 to the "OFF" position (FIG. 1), and opening movement of the contact arm 29 for all of the pole units in a manner well known in the art.

The circuit breaker is manually closed by counterclockwise movement of the handle portion 55 from the "OFF" position to the "ON" position, which movement causes the spring 45 to move overcenter and straighten the toggle links 41, 43, thereby moving the contact arm 29 for all of the pole units to the closed position as shown in broken line position 29*a*.

The trip device 15 serves to effect automatic release of the releasable cradle or arm 49 and opening of the breaker contacts for all of the pole units, in response to predetermined overload conditions in the circuit breaker through any or all pole units of the circuit breaker, in a manner described hereinbelow.

The circuit through each pole unit extends from a left-hand terminal 63 through the conductor 23, the contacts 21, 27, the contact arm 29, a flexible conductor 65, a conductor 67, a trip conductor 69, and to a right-hand terminal connector 71. Bolt 73 secures one end of the trip conductor 69 to the conductor 67 and the other end of the trip conductor 69 is disposed between a backup plate 75 and the terminal 71 where it is secured in place by mounting bolt 77 of the terminal 71.

The latch and trip device 15 comprises a molded insulating housing base 81 and a molded insulating housing cover 79 secured to the base to enclose a molded insulating trip bar 83 that is common to all three of the pole units. The base 81 includes a pair of spaced partitions (one of which portions 85 is shown) which are vertically disposed and integral with the base for separating the interior of the housing into three compartments, each compartment containing one of the three poles. In a similar manner, the cover 79 is provided with corresponding partitions having mating surfaces therewith in a manner similar to the mating surfaces of the peripheral surfaces of the base 81 and cover 79 as indicated by a parting line 89 (FIG. 1).

As set forth in U.S. Pat. No. 3,797,007, the trip bar 83 is actuated in response to a low persistent overload current below a predetermined value of, for example, ten times normal rated current, whereby a bimetal 91 is heated and deflects the trip bar 83 clockwise. The trip bar 83 is also deflected by an armature 93 when an overload current above a value such, for example, as ten times normal rated current or short circuit current occurs, causing a core 95 to attract the armature clockwise and against the trip bar 83. Deflection of the trip bar 83 rotates a trip lever 97 that, in turn, releases the arm 49 which is pivoted at pin 99, whereby the circuit breaker mechanism 7 is tripped.

Figure 2:
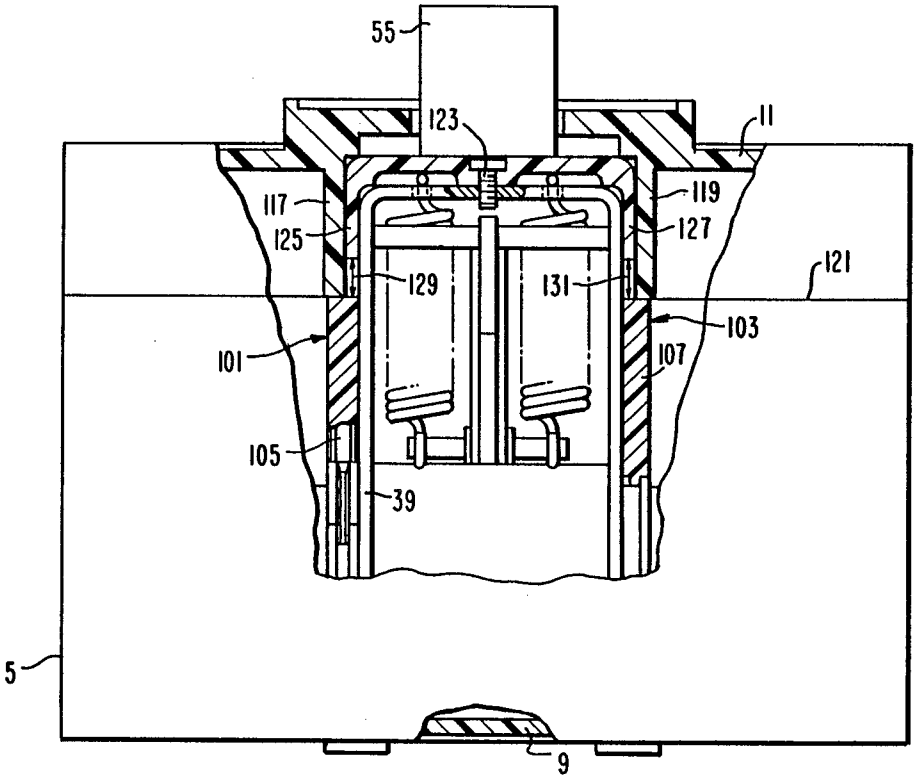
FIG. 2 is an enlarged vertical sectional view taken on the line II—II of FIG. 1.
Figure 3:
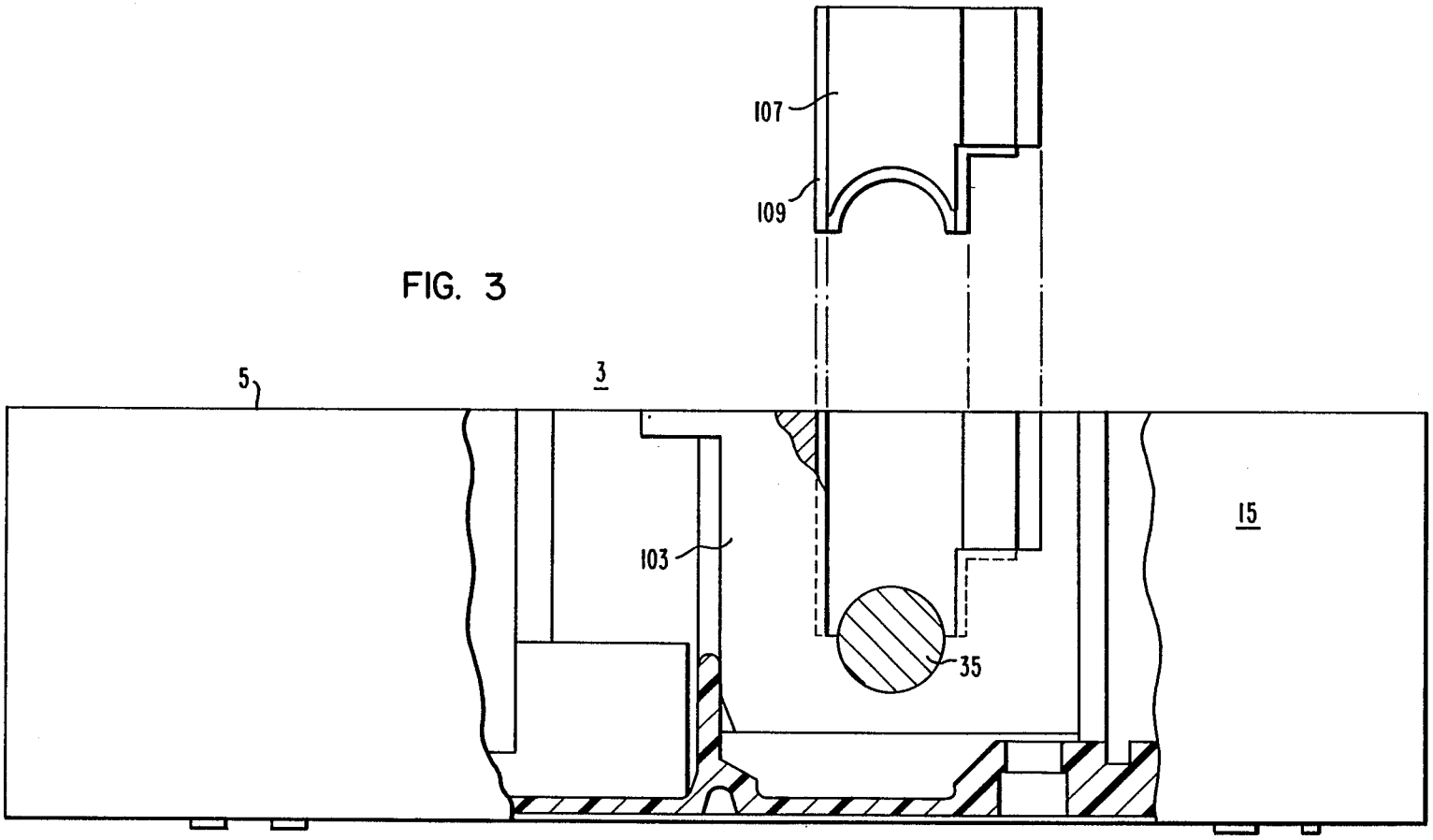
FIG. 3 is a vertical sectional view of the circuit breaker housing showing the manner in which the barrier portion is inserted and removed in place.
Figure 5:
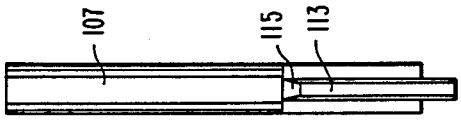
FIG. 5 is an end elevational view taken on the line V—V of FIG. 4.
Figure 6:
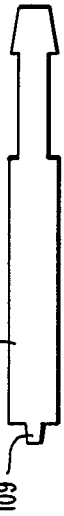
FIG. 6 is a plan view taken on the line VI—VI of FIG. 4.
Figure 4:
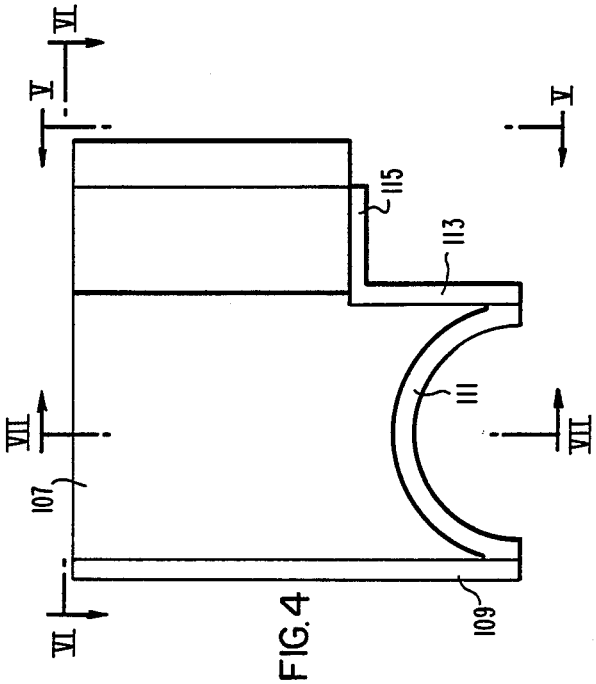
FIG. 4 is an elevational view of the barrier portion.
Figure 7:
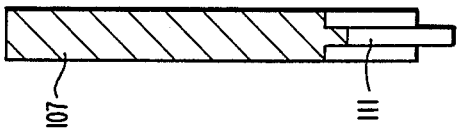
FIG. 7 is a fragmentary vertical sectional view taken on the line VII—VII of FIG. 4.

As shown in FIGS. 1, 2 and 3, the circuit breaker 3 is a multi-phase circuit breaker characterized by a plurality of phase compartments separated by spaced barriers 101, 103 by which the circuit breaker is divided into three compartments each containing a pair of separable contacts, such as a contact 21, 27 in the center compartment. As is well known in the art, the interphase barriers 101, 103 are comprised of a dielectric material and are preferably integral parts of the molded base 9 and cover 11 which are comprised of dielectric material, such as glass polyester. As is well known in the art, the barriers prevent flashover or arcing between the faces, and prevent intermingling of gasses between the faces to avoid internal gas pressure within the housing walls.

To facilitate insertion of the tie bar 35 which extends between the several phases through the barriers 101, 103, each barrier is provided with a detachable barrier portion 105, 107, respectively. The barrier portions are inserted into place, such as the barrier portion 107 (FIG. 3), after placement of the tie bar 35. In FIGS. 4–7, the construction details of the barrier 107 are shown. For example, the barrier portion or insert 107 includes a rib or tongue 109 that is aligned with rib or tongue portions 111, 113, and 115. The tongues 109, 111, 113, 115 fit into complementary grooves in correspondingly adjacent parts of the barrier 103 and tie bar 35. In this manner, interfitting surface joints are provided between the barrier 103 and barrier portion 107, as well as between the barrier 101 and barrier portion 105. The interfitting joint between the barrier parts substantially eliminates creep between the adjacent phases and prevents intermingling of gasses therebetween.

The interfitting joint also facilitates placement and retention of the detachable barrier portions 105, 107 in place during operation of the circuit breaker. For that purpose, the cover 11 includes spaced barriers 117, 119 (FIG. 2) which are integral with the molded cover and which are aligned an in abutment with corresponding barriers 101, 103 at a parting surface 121 of the base 9 and cover 11. Accordingly, when the cover 11 is in place, the barriers 117, 119 retain the barrier portions 105, 107 in place.

In accordance with this invention, when the cover 11 is not in place on the base 9 such as during handling, assembly, and maintenance, the barrier portions 101, 103 are free to slide out of place and possibly become lost. To avoid that possibility, the handle 55, which is attached to the operating lever 39 by a screw 123, is a molded member and includes laterally extending portions spaced flanges 125, 127 which are aligned with the barrier portions 105, 107 such as indicated by arrows 129, 131 (FIG. 2). Thus, the barriers 125, 127 prevent the barrier portions 105, 107 from falling out of position or out of the circuit breaker, no matter in what position the circuit breaker is disposed.

In conclusion, the device of this invention provides detachable barrier portions between phases of a circuit breaker having fins or tongues and grooves for interlocking parts to facilitate placement and retention of the barrier portion in place as well as to avoid arcstriking or flashover as well as creeping and intermingling of gasses between adjacent phases.

What is claimed is:

1. A multi-phase circuit breaker comprising:

a housing having a detachable cover;

a plurality of barriers separating the housing into isolated phase compartments;

a circuit breaker structure within each compartment and having a pair of contacts operable to open and close an electric circuit;

manually operable means for opening and closing the contacts simultaneously in the compartments and including a crossbar extending transversely of the compartments and through the barriers;

each barrier comprising first and second barrier portions, the first barrier portion being detachably mounted and having surfaces forming a crossbar-receiving opening and supporting the crossbar; and each second barrier portion being an integral part of the cover and being aligned and in abutment with a corresponding first barrier portion when the cover is mounted on the housing.

2. The circuit breaker of claim 1 in which each pair of barrier and first barrier portion comprise complementary surfaces forming the crossbar-receiving opening.

3. The circuit breaker of claim 2 in which the assembly of each barrier and first barrier portion comprise interlocking grooves and ribs.

* * * * *